US010916180B2

(12) United States Patent
Mei et al.

(10) Patent No.: US 10,916,180 B2
(45) Date of Patent: Feb. 9, 2021

(54) DISPLAY PANEL AND MANUFACTURING METHOD THEREOF

(71) Applicant: Wuhan China Star Optoelectronics Technology Co., Ltd., Wuhan (CN)

(72) Inventors: Xindong Mei, Wuhan (CN); Weihong Yin, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 16/484,465

(22) PCT Filed: Nov. 2, 2018

(86) PCT No.: PCT/CN2018/113719

§ 371 (c)(1),
(2) Date: Aug. 8, 2019

(87) PCT Pub. No.: WO2020/056876

PCT Pub. Date: Mar. 26, 2020

(65) Prior Publication Data

US 2020/0143735 A1 May 7, 2020

(30) Foreign Application Priority Data

Sep. 18, 2018 (CN) ..... 2018 1 1085096

(51) Int. Cl.
*G09G 3/20* (2006.01)

(52) U.S. Cl.
CPC ... *G09G 3/2092* (2013.01); *G09G 2310/0275* (2013.01)

(58) Field of Classification Search
CPC ..... G09G 3/3266; G09G 2300/0426
See application file for complete search history.

(56) References Cited

U.S. PATENT DOCUMENTS

2008/0266210 A1* 10/2008 Nonaka ..... G11C 19/28 345/55
2015/0221272 A1* 8/2015 Xu ..... G09G 3/3674 345/211

(Continued)

OTHER PUBLICATIONS

Nimisha Kaushik. "Difference Between Circle and Ellipse." DifferenceBetween.net. Mar. 13, 2018 < http://www.differencebetween.net/science/mathematics-statistics/difference-between-circle-and-ellipse/ >. (Year: 2018).*

*Primary Examiner* — Dong Hui Liang

(57) ABSTRACT

A display panel and a manufacturing method are provided. The display panel includes an array substrate, gate signal lines, and gate driving circuits. The array substrate includes a display area and a non-display area around the display area. The display area has a geometric center and an outline between the display area and the non-display area. The gate signal lines are disposed in the display area, and each gate signal line intersects the outline of the display area to form at least one intersection point. The gate driving circuits are disposed in the non-display area and respectively electrically connected to the gate signal lines, and each gate driving circuit has a positioning line. For a gate driving circuit and at least one intersection point that correspond to the same gate signal line, the positioning line is aligned with a line segment that connects the intersection point and the geometric center.

5 Claims, 2 Drawing Sheets

(56) References Cited

U.S. PATENT DOCUMENTS

| | | | | |
|---|---|---|---|---|
| 2016/0225306 | A1* | 8/2016 | Shin | G02F 1/1333 |
| 2016/0240141 | A1* | 8/2016 | Lee | G09G 3/3258 |
| 2017/0219895 | A1* | 8/2017 | Yu | G02F 1/1368 |
| 2018/0031898 | A1* | 2/2018 | Tanaka | G02B 6/005 |
| 2018/0286316 | A1* | 10/2018 | Yuki | G02F 1/133308 |
| 2020/0135764 | A1* | 4/2020 | Ha | H01L 27/3276 |

* cited by examiner

DISPLAY PANEL AND MANUFACTURING METHOD THEREOF

RELATED APPLICATIONS

This application is a National Phase of PCT Patent Application No. PCT/CN2018/113719 having International filing date of Nov. 2, 2018, which claims the benefit of priority of Chinese Patent Application No. 201811085096.0 filed on Sep. 18, 2018. The contents of the above applications are all incorporated by reference as if fully set forth herein in their entirety.

FIELD AND BACKGROUND OF THE INVENTION

The present disclosure relates to the field of display technology, and more particularly, to a display panel and a manufacturing method thereof.

With the fast development of display technology, in addition to conventional square display devices, a ratio of display devices with odd shapes in terminal applications has gradually increased. Currently, the display devices with odd shapes, such as circular display devices, elliptical display devices, curved display devices, fan-type display devices, and so on, are commonly found.

A display device mainly includes a display panel, data lines, gate lines, data driving circuits, and gate driving circuits. In structures of conventional display panels, the gate driving circuits can be manufactured in non-display areas on the display panel by using gate driver on array (GOA) technology instead of connecting driving chips, thereby improving product yield and reducing product costs and a width of frame of the display panel so that artistic narrow frame design can be realized.

Compared with the square display devices, it is more difficult and complicated to dispose GOA circuits in the display devices with odd shapes due to a factor in shapes. Even through automatic disposition by using software, there still exist problems such as low efficiency in designing layouts, bad layout space utilization, and so on.

Therefore, it is necessary to provide a display panel and a manufacturing method thereof to solve the above problems.

SUMMARY OF THE INVENTION

A technical problem is that, the present disclosure aims to provide a display panel and a manufacturing method thereof to improve efficiency in designing layouts and layout space utilization for display devices with odd shapes.

In order to realize the above object, the present disclosure provides a display panel, including: an array substrate including a display area and a non-display area around the display area, wherein the display area has a geometric center and an outline between the display area and the non-display area;

a plurality of gate signal lines disposed in the display area, wherein each of the plurality of gate signal lines intersects the outline of the display area to form at least one intersection point; and a plurality of gate driving circuits disposed in the non-display area and respectively electrically connected to the plurality of gate signal lines, wherein each of the plurality of gate driving circuits has a positioning line; wherein for a gate driving circuit and at least one intersection point that correspond to the same gate signal line, the positioning line is aligned with a line segment that connects the at least one intersection point and the geometric center.

In some embodiments, for a gate driving circuit and at least one intersection point that correspond to the same gate signal line, the gate driving circuit and the at least one intersection point are disposed at a predetermined interval.

In some embodiments, the each of the plurality of gate driving circuits includes a connecting line electrically connected to a corresponding gate signal line.

In some embodiments, the display area has a shape of a circle, and the geometric center is located at the center of the circle of the display area.

In some embodiments, the display area has a shape of an ellipse or an irregularity.

In some embodiments, the each of the plurality of gate driving circuits is a gate driver on array (GOA) circuit formed on the array substrate.

In some embodiments, an included angle β is formed between the horizon and the line segment that connects the at least one intersection point and the geometric center.

In order to realize the above object, the present disclosure provides a method of manufacturing a display panel including an array substrate that includes a display area and a non-display area around the display area, a plurality of gate signal lines disposed in the display area, wherein the method includes:

calculating a geometric center of the display area and an outline between the display area and the non-display area;

calculating at least one intersection point at which each of the plurality of gate signal lines intersects the outline of the display area; and disposing a plurality of gate driving circuits in the non-display area to be respectively electrically connected to the plurality of gate signal lines, wherein each of the plurality of gate driving circuits has a positioning line, and wherein for a gate driving circuit and at least one intersection point that correspond to the same gate signal line, the positioning line is aligned with a line segment that connects the at least one intersection point and the geometric center.

In some embodiments, an included angle β is formed between the horizon and the line segment that connects the at least one intersection point and the geometric center.

In some embodiments, the method further includes turning the each of the plurality of gate driving circuits through the included angle β to cause the positioning line to be aligned with the line segment that connects the at least one intersection point and the geometric center prior to the step of disposing a plurality of gate driving circuits in the non-display area to be respectively electrically connected to the plurality of gate signal lines.

In some embodiments, for a gate driving circuit and at least one intersection point that correspond to the same gate signal line, the gate driving circuit and the at least one intersection point are disposed at a predetermined interval.

In some embodiments, the display area has a shape of a circle, and the geometric center is located at the center of the circle of the display area.

In some embodiments, the display area has a shape of an ellipse or an irregularity.

In some embodiments, the each of the plurality of gate driving circuits is a gate driver on array (GOA) circuit formed on the array substrate.

The beneficial effect of the present disclosure is that, in a display panel and a manufacturing method thereof provided in the present disclosure, a position of disposing a corresponding gate driving circuit can be calculated mainly through intersection points at which the gate signal lines intersect the outline of the display area. Owing to feasible calculating rules and automatic disposition by using software, efficiency in designing layouts and layout space utilization for display devices with odd shapes are significantly improved. In addition, the gate driving circuits in the present disclosure can be disposed to be the same distance away as corresponding gate signal lines and thus to be symmetrical, causing the display panel to have good uniformity of resistance.

BRIEF DESCRIPTION OF THE SEVERAL VIEWS OF THE DRAWINGS

To ensure the features and the technical content of the disclosure are more apparent and easier to understand, please refer to the explanation and the accompanying drawings of the disclosure as follows. However, the accompanying drawings are merely for reference without limiting the disclosure.

DESCRIPTION OF SPECIFIC EMBODIMENTS OF THE INVENTION

To ensure the objects, the technical solutions, and the effects of the disclosure are clearer and more specific, the disclosure will be explained in conjunction with the accompanying drawings in detail further below. It should be understood that the embodiments described herein are merely a part of the embodiments of the present disclosure instead of all of the embodiments and not used to limit the disclosure.

Figure 1:
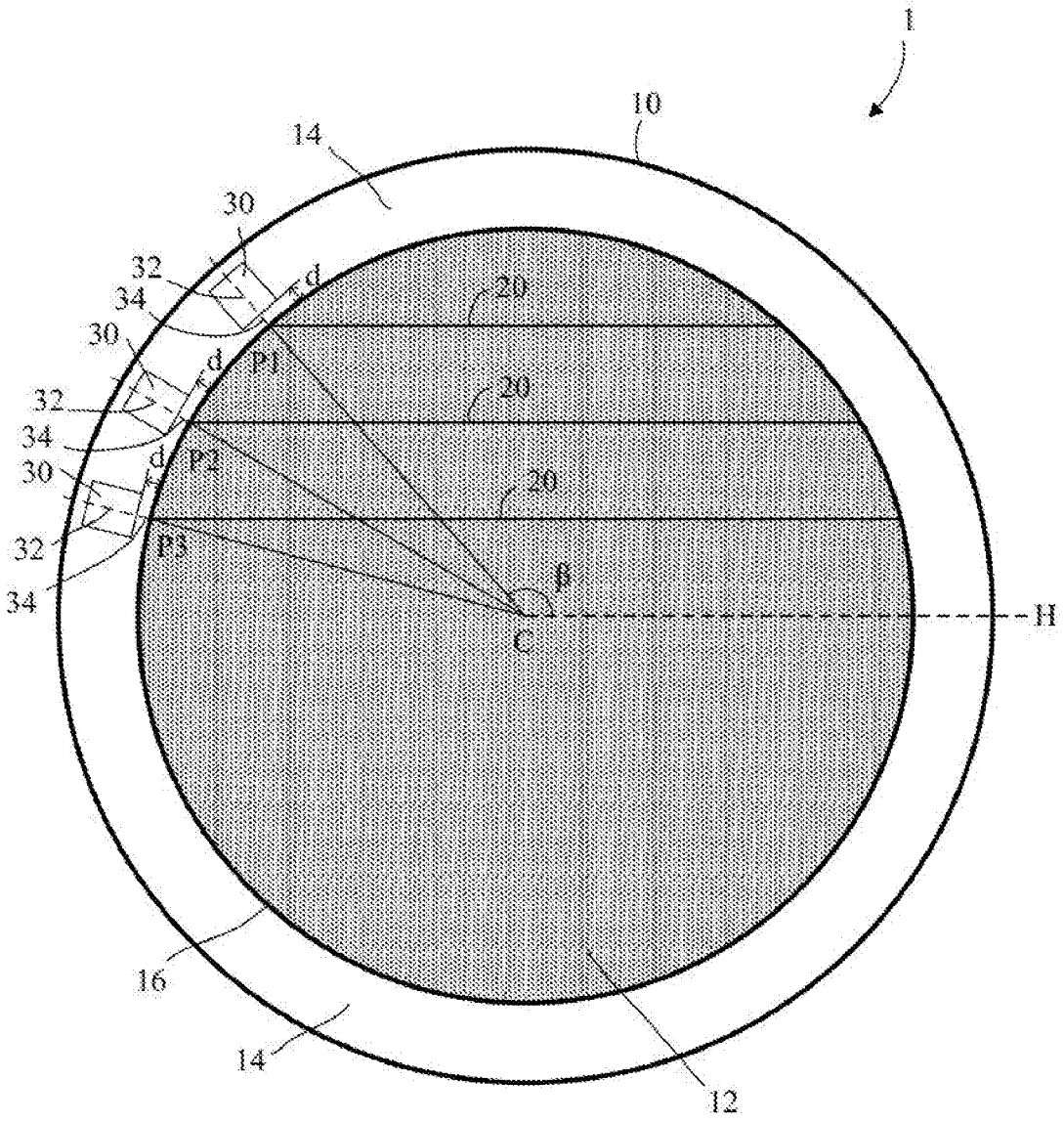
FIG. 1 is a schematic structural diagram of a display panel according to an embodiment of the present disclosure.

Please refer to FIG. 1, which is a schematic structural diagram of a display panel according to an embodiment of the present disclosure. A display panel 1 includes an array substrate 10. The array substrate 10 includes a display area 12 and a non-display area 14 around the display area 12. The display area 12 has a geometric center C and an outline 16 between the display area 12 and the non-display area 14. In an embodiment of the present disclosure, the display area 12 has a shape of a circle, and the geometric center C is located at the center of the circle of the display area 12. However, the display area 12 can also have a shape of an ellipse or an irregularity without being limited to the above embodiment.

As shown in FIG. 1, a plurality of gate signal lines 20 are disposed in the display area 12, and each of the plurality of gate signal lines 20 intersects the outline 16 of the display area 12 to form at least one intersection point such as P1, P2, and P3. A plurality of gate driving circuits 30 are disposed in the non-display area 14 and respectively electrically connected to the plurality of gate signal lines 20. Each of the gate driving circuits 30 has a positioning line 32. The positioning line 32 can be specifically considered as a line or an icon marked on the gate driving circuits 30, or a virtual positioning line calculated by computers through an image processing procedure.

As shown in FIG. 1, for the gate driving circuit 30 and the at least one intersection point (such as P1, P2, and P3) that correspond to the same gate signal line 20, the positioning line 32 is aligned with a line segment (such as P1-C, P2-C, and P3-C) that connects the at least one intersection point (such as P1, P2, and P3) and the geometric center C. Specifically, an included angle β is formed between the horizon H and the line segment (such as P1-C, P2-C, and P3-C) that connects the at least one intersection point (such as P1, P2, and P3) and the geometric center C. In FIG. 1, an included angle between the horizon H and the line segment P1-C represents the included angle β.

Specifically, for the gate driving circuit 30 and the at least one intersection point (such as P1, P2, and P3) that correspond to the same gate signal line 20, the gate driving circuit 30 and the at least one intersection point (such as P1, P2, and P3) are disposed at a predetermined interval d.

Specifically, each of gate driving circuits 30 is a gate driver on array (GOA) circuit formed on the array substrate 10. Each of gate driving circuits 30 includes a connecting line 34 electrically connected to a corresponding gate signal line 20.

Figure 2:
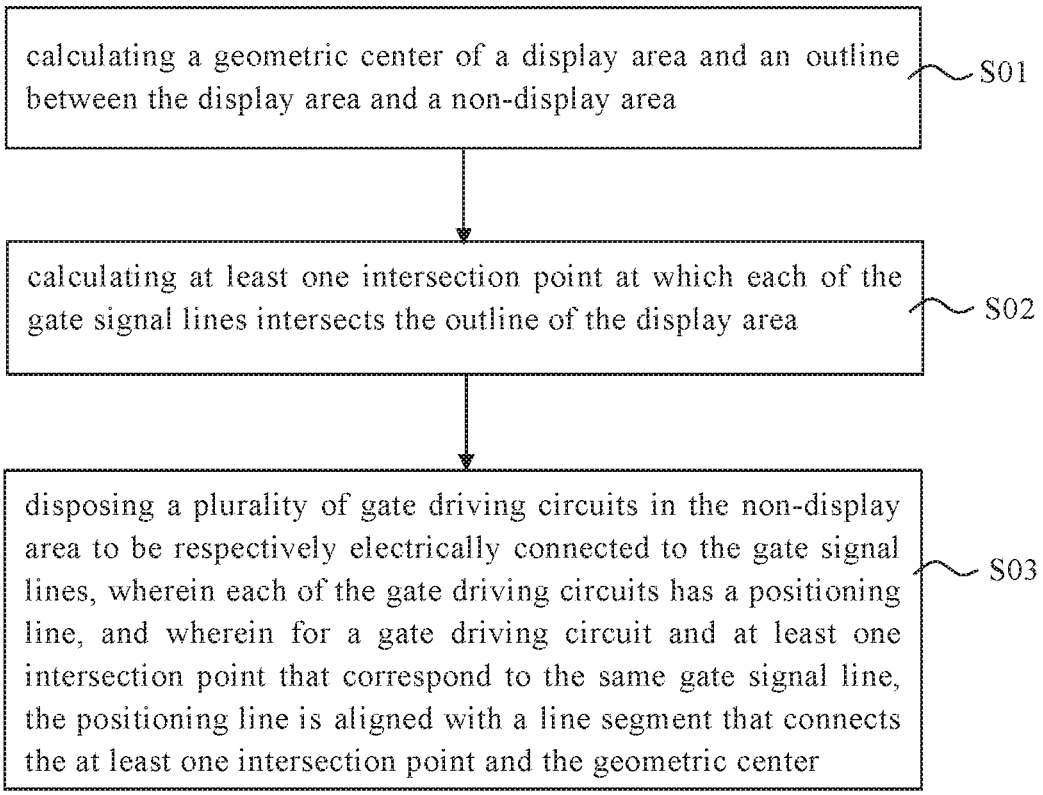
FIG. 2 is a flowchart of a method for manufacturing a display panel according to an embodiment of the present disclosure.

FIG. 2 is a flowchart of a method for manufacturing a display panel according to an embodiment of the present disclosure. Also referring to FIG. 1, the display panel 1 includes the array substrate 10 that includes the display area 12 and the non-display area 14 around the display area 12, and the plurality of gate signal lines 20 are disposed in the display area 12. In the present disclosure, the method of manufacturing the display panel 1 includes the following steps:

In step S01, calculating the geometric center C of the display area 12 and the outline 16 between the display area 12 and the non-display area 14. In the embodiment of FIG. 1, the display area 12 has a shape of a circle, and the geometric center C of the display area 12 is calculated to be the center of the circle of the display area 12. In addition, the display area 12 can further have a shape of an ellipse or an irregularity. A geometric center of the display area 12 having a shape of an ellipse or an irregularity can also be calculated through step S01.

In step S02, calculating the at least one intersection point (such as P1, P2, and P3 in FIG. 1) at which each of the gate signal lines 20 intersects the outline 16 of the display area 12.

In step S03, disposing the plurality of gate driving circuits 30 in the non-display area 14 to be respectively electrically connected to the plurality of gate signal lines 20. Each of the gate driving circuits 30 has the positioning line 32, and for the gate driving circuit 30 and the at least one intersection point (such as P1, P2, and P3) that correspond to the same gate signal line 20, the positioning line 32 is aligned with the line segment (such as P1-C, P2-C, and P3-C) that connects the at least one intersection point (such as P1, P2, and P3) and the geometric center C.

Specifically, the included angle β is formed between the horizon H and the line segment (such as P1-C, P2-C, and P3-C) that connects the at least one intersection point (such as P1, P2, and P3) and the geometric center C. In FIG. 1, an included angle between the horizon H and the line segment P1-C represents the included angle β.

Furthermore, the method further includes turning each of gate driving circuits 30 through the included angle β to cause the positioning line 32 to be aligned with the line segment (such as P1-C, P2-C, and P3-C) that connects the at least one intersection point (such as P1, P2, and P3) and the geometric center C prior to the step of disposing the gate driving circuits 30 in the non-display area 14 to be respectively electrically connected to the gate signal lines 20.

Specifically, for the gate driving circuit 30 and the at least one intersection point (such as P1, P2, and P3) that correspond to the same gate signal line 20, the gate driving circuit 30 and the at least one intersection point (such as P1, P2, and P3) are disposed at the predetermined interval d. Further, each of gate driving circuits 30 can be a gate driver on array (GOA) circuit formed on the array substrate 10.

In conclusion, in a display panel and a manufacturing method thereof provided in the present disclosure, a position of disposing a corresponding gate driving circuit can be calculated mainly through intersection points at which the gate signal lines intersect the outline of the display area. Owing to feasible calculating rules and automatic disposition by using software, efficiency in designing layouts and layout space utilization for display devices with odd shapes are significantly improved. In addition, the gate driving circuits in the present disclosure can be disposed to be the same distance away as corresponding gate signal lines and thus to be symmetrical, causing the display panel to have good uniformity of resistance.

It should be understood that the application of the present disclosure is not limited by the foregoing examples. A person of ordinary skill in the art is able to make modifications or changes based on the foregoing description, and all of these modifications and changes are within the scope of the appended claims of the present disclosure.

The industrial applicability of the present disclosure is that, in a display panel and a manufacturing method thereof provided in the present disclosure, a position of disposing a corresponding gate driving circuit can be calculated mainly through intersection points at which the gate signal lines intersect the outline of the display area. Owing to feasible calculating rules and automatic disposition by using software, efficiency in designing layouts and layout space utilization for display devices with odd shapes are significantly improved.

What is claimed is:

1. A method of manufacturing a display panel comprising an array substrate that comprises a display area having an irregular shape or an elliptical shape not including a circle, a non-display area around the display area, and a plurality of gate signal lines disposed in the display area, wherein the method comprises:

calculating a geometric center of the display area and an outline between the display area and the non-display area;

calculating at least one intersection point at which each of the plurality of gate signal lines intersects the outline of the display area; and disposing a plurality of gate driving circuits in the non-display area to be respectively electrically connected to the plurality of gate signal lines, wherein each of the plurality of gate driving circuits has a positioning line, and wherein for a gate driving circuit and at least one intersection point that correspond to the same gate signal line, the positioning line is aligned with a line segment that connects the at least one intersection point and the geometric center.

2. The method of claim 1, wherein an included angle f3 is formed between the horizon and the line segment that connects the at least one intersection point and the geometric center.

3. The method of claim 2, further comprising: turning the each of the plurality of gate driving circuits through the included angle θ to cause the positioning line to be aligned with the line segment that connects the at least one intersection point and the geometric center prior to the step of disposing a plurality of gate driving circuits in the non-display area to be respectively electrically connected to the plurality of gate signal lines.

4. The method of claim 1, wherein for a gate driving circuit and at least one intersection point that correspond to the same gate signal line, the gate driving circuit and the at least one intersection point are disposed at a predetermined interval.

5. The method of claim 1, wherein the each of the plurality of gate driving circuits is a gate driver on array (GOA) circuit formed on the array substrate.

* * * * *